US005873525A

United States Patent [19]

Shearer

[11] Patent Number: 5,873,525

[45] Date of Patent: Feb. 23, 1999

[54] SNOW GUN TOWERS

[75] Inventor: Steven Shearer, Bryant Pond, Me.

[73] Assignee: Sunday River Ski Resort, Bethel, Me.

[21] Appl. No.: 972,837

[22] Filed: Nov. 18, 1997

[51] Int. Cl.[6] ..... F25C 3/04; A62C 31/24

[52] U.S. Cl. ..... 239/14.2; 239/280; 239/280.5; 239/587.1; 239/587.5; 248/292.13

[58] Field of Search ..... 239/2.2, 14.2, 239/273, 280, 280.5, 587.1, 587.5; 248/292.11, 292.13

[56] References Cited

U.S. PATENT DOCUMENTS

| | | | |
|---|---|---|---|
| 2,857,201 | 10/1958 | Palmer | 239/587.5 X |
| 3,451,628 | 6/1969 | Kelley | 239/587.5 |
| 4,465,230 | 8/1984 | Ash | 239/14.2 X |
| 5,011,029 | 4/1991 | Sagasawara et al. | 248/292.13 X |
| 5,360,163 | 11/1994 | Dupre | 239/14.2 |
| 5,400,965 | 3/1995 | Ratnik et al. | 239/2.2 |
| 5,425,505 | 6/1995 | Jones | 239/587.1 X |
| 5,699,961 | 12/1997 | Ratnik et al. | 239/14.2 |

*Primary Examiner*—Andres Kashinikow
*Assistant Examiner*—Robin O. Evans
*Attorney, Agent, or Firm*—Pierce Atwood; Chris A. Caseiro; Celia H. Leber

[57] ABSTRACT

Snow gun towers are provided for supporting a snow gun above the ground, e.g., above a ski trail. The towers are constructed to be easily rotated between raised and lowered positions, and to maintain the angle of the snow gun with respect to the ground substantially constant during rotation of the tower between its positions. Preferred towers include a compression spring to assist the user in moving the tower between raised and lowered positions.

13 Claims, 6 Drawing Sheets

SNOW GUN TOWERS

BACKGROUND OF THE INVENTION

The present invention relates to snow gun towers.

Many ski resorts use snow-making equipment to produce man-made snow when natural snow is unavailable or to supplement the available quantity of natural snow. Snow-making equipment typically includes a number of snow guns arranged at intervals along the side of or on a ski trail. Snow guns include nozzles through which a mixture of compressed air and water is sprayed into the ambient air. The rapid expansion of the compressed air in the relatively cool ambient air causes the water to cool and form snow crystals. Snow guns are described, for example, in U.S. Pat. No. 4,465,230.

Snow guns may be mounted on fixed tower mounts, or on ground mounts that can be easily moved to different locations. While tower mounts allow the snow gun to be mounted high above the trail, for longer hang time and thus better freezing of the snow crystals, tower mounts are typically difficult to adjust, if they are adjustable at all. This lack of ready adjustability makes use of tower mounts impractical if the wind direction is unfavorable to the direction in which the snow gun is facing.

SUMMARY OF THE INVENTION

The present invention provides snow gun towers that can be easily adjusted to a wide range of positions. Preferred towers are spring-loaded, and thus require little strength to adjust. Their adjustability allows the snow gun mounted on the tower to operate optimally under most wind conditions, and provides an even spread of snow across the trail. The ability of the towers to lower the snow gun allows the snow gun to be moved out of the wind or other weather conditions. Moreover, preferred towers include a self-leveling mount which maintains the snow gun nozzle at a predetermined angle relative to the horizontal, regardless of the position of the snow gun tower.

In one aspect, the invention relates to a snow gun tower for mounting a snow gun having an air inlet, a water inlet, and a nozzle. The snow gun tower includes (a) a base plate; (b) an elongated air supply tube having a first end pivotally mounted on the base plate to allow the air supply tube to be rotated between a raised and a lowered position; (c) an elongated water supply tube disposed in spaced, parallel relation to the air supply tube and having a first end pivotally mounted on the base plate to allow the water supply tube to be rotated with the air supply tube between its raised and lowered positions; and (d) a swivel mount constructed to allow a predetermined amount of relative axial movement of the air supply tube and water supply tube during rotation of the air and water supply tubes between their raised and lowered position.

In preferred embodiments, the swivel mount includes a first pivotal coupling between the air supply tube and the air inlet of the snow gun, and a second pivotal coupling between said water supply tube and the water inlet of the snow gun. Preferably, the snow gun tower also includes a biasing member to aid in raising and lowering the tower.

In another aspect, the invention relates to a snow gun tower for mounting a snow gun having an air inlet, a water inlet, and a nozzle. The snow gun tower includes (a) a base plate; (b) an elongated air supply tube having a first end pivotally mounted on the base plate to allow the air supply tube to be rotated between a raised and a lowered position; (c) an elongated water supply tube disposed in spaced, parallel relation to the air supply tube and having a first end pivotally mounted on the base plate to allow the water supply tube to be rotated with the air supply tube between its raised and lowered positions; (d) a snow gun mount at the second end of the air and water supply tubes, constructed to receive the air and water inlets of the snow gun; and (e) a biasing member mounted on the supply tube that is closest to the ground when the air and water supply tubes are in their lowered positions, to provide a mechanical advantage when the tubes are moved between their raised and lowered positions by supporting a portion of the weight of the tubes.

In preferred embodiments, the biasing member is a compression spring. Preferably, the compression spring has a spring rate of from about 200 to 600 pounds/inch and a total deflection of from about 6 to 10 inches.

Other features and advantages of the invention will be apparent from the following detailed description, the drawings, and the claims.

DETAILED DESCRIPTION OF PREFERRED EMBODIMENTS

Figure 1:
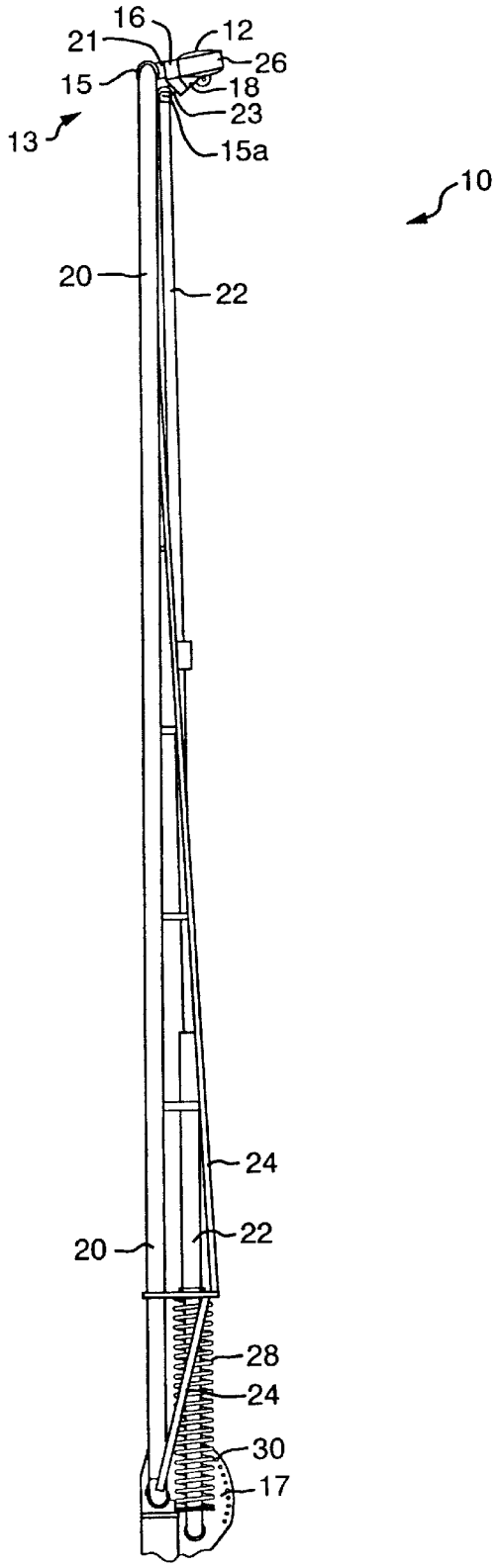
FIG. 1 is a side view of a snow gun tower according to one aspect of the invention, in its raised position.

Referring to the figures, a snow gun tower 10 has a snow gun 12 mounted at its free end 14. Snow gun 12 has an air inlet 16 and a water inlet 18, in fluid communication with, respectively, air tube 20 and water tube 22 of tower 10. Tower 10 holds the snow gun 12 a desired distance above the ground, at a desired level, and provides a conduit for supplying water and air to the snow gun.

Air tube 20 and water tube 22 are a pair of highly elongated rigid tubes, e.g., steel pipes, constructed to deliver air and water, respectively, from air and water supply sources (not shown) to the snow gun 12. The two tubes 20, 22 are substantially the same length, and include a swivel mount 13 at the free end 14 of the tubes. The swivel mount 13 includes a pivotal coupling 15, 15*a* at the free end of each of the tubes, and a short length of air pipe 21 and water pipe 23 pivotally connected to each pivotal coupling at one end and inserted into the respective inlet of the snow gun at the other end. The swivel mount allows the snow gun to swivel with respect to the corresponding air tube 20 and water tube 22. The attachment of the snow gun to the swivel mount holds the free ends of the two tubes in a fixed spaced relationship, while allowing the tubes to move axially with respect to each other, as will be explained further below.

The air tube 20 and water tube 22 are pivotally mounted in a base plate 17, to allow the tower to be moved between its raised and lowered positions by pivoting of the air and water tubes. The tower 10 can be fixed in a desired position by inserting a pin (not shown) into one of holes 30 in the base plate 17, in a position in which the pin will restrict rotational downward movement of the tubes 20, 22. In the preferred embodiment shown in FIG. 1, the air and water tubes 20, 22 are mounted in base plate 17 so that the end of the air tube 20 is slightly higher than the end of the water tube 22. However, the positions of the air and water tubes 20, 22 can be reversed (so that the water tube is "on top" when the tower is lowered) and their ends may be mounted so that the end of the water tube 22 is slightly higher than the end of the air tube 20. Brace 24 is connected to air tube 20 to reinforce the tower structurally. Water tube 22 slides freely within the brace 24.

Because the air and water tubes 20, 22 have substantially the same length, when the tower 10 is in the raised position (FIG. 1) the end of the air tube is positioned slightly higher than the respective end of the water tube. In this position, the swivel mount places the nozzle 26 of snow gun 12 in an advantageous, forward-pointing position (see FIG. 1).

Figure 1A:
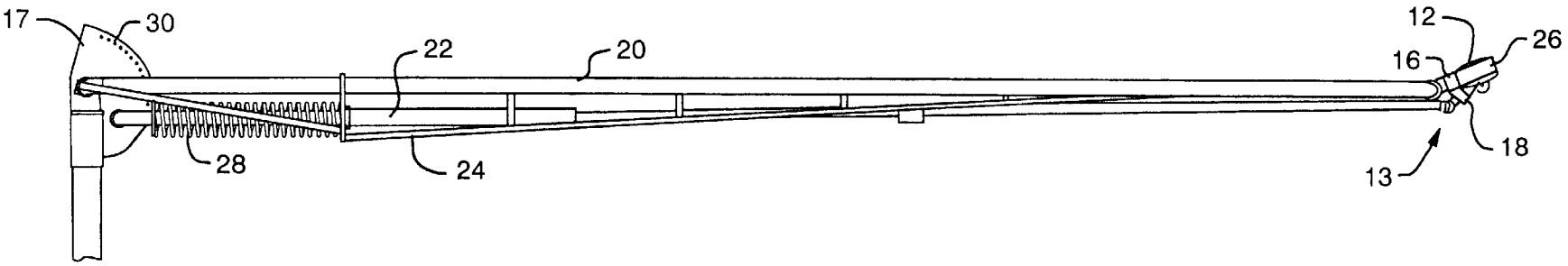
FIG. 1*a* is a side view of the tower of FIG. 1 in its lowered position.
Figure 2:
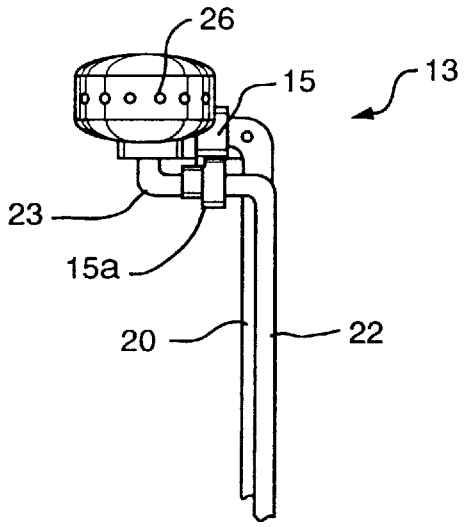
FIG. 2 is a detailed front view of the snow gun and upper portion of the tower shown in FIG. 1.

When the tower is moved to a lowered position (e.g., as shown in FIG. 1*a*), the relative positioning of air and water tubes 20, 22, together with the swivel and pivoting mounting of their ends, causes the water tube to act as a pushrod, maintaining the nozzle 26 of snow gun 12 at a constant angle with respect to the horizontal. Thus, even when the tower 10 is lowered to a horizontal position, as shown in FIG. 1*a*, the nozzle 26 remains in an advantageous position—pointing out across a trail, rather than pointing down at the ground. Preferably, the angle of the nozzle 26 of the snow gun 12 with respect to the horizon is 20° to 30°.

Figure 4:
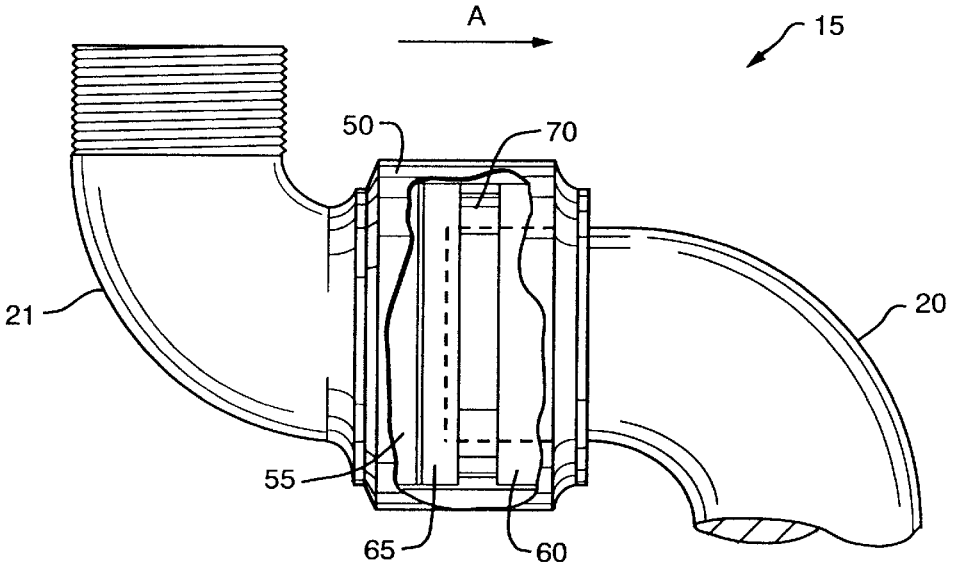
FIGS. 4 and 4*a* are side views in partial cross-section of air and water pivotal couplings, respectively, suitable for use in the tower of FIG. 1.

A preferred pivotal coupling 15, connecting the air tube 20 and air pipe 21, is shown in detail in FIG. 4. The pivotal coupling 15 includes housing ring 50. A spacer ring 55 is connected to the housing ring 50 and the air tube 20. A connecting ring 60 is connected to the housing ring 50, so that housing ring 50 forms a rigid connection between connecting ring 60 and air tube 20. A flange ring 65 is connected to the end of air pipe 21 to movably retain the end 64 of air pipe 21 within housing ring 50. An elastomeric washer 70 is placed between the flange ring 65 and connecting ring 60. As air pressure through the pivotal coupling, in the direction indicated by arrow A, is increased, air pipe 21 is forced in the direction of arrow A, causing flange ring 65 to compress washer 70 against connecting ring 60. As a result, the pressure on washer 70 increases, creating a seal that allows 360° motion of the pivotal coupling 15 while pressurized, without leakage.

Figure 4A:
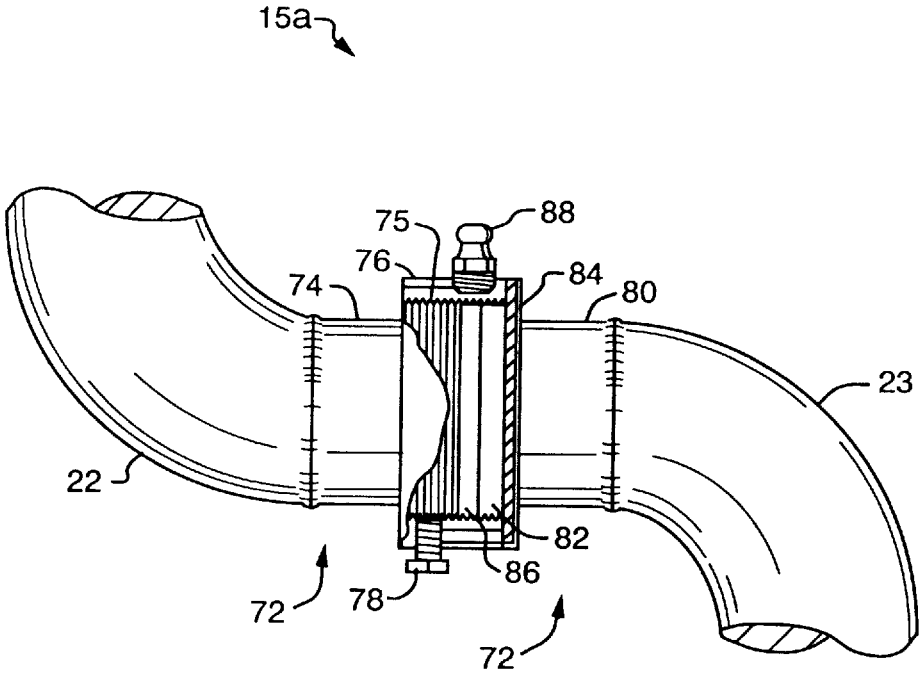

A preferred pivotal coupling 15*a,* connecting the water tube 22 and water pipe 23, is shown in detail in FIG. 4*a*. Pivotal coupling 15*a* includes a forged steel union 72 that is connected, e.g., by welding, between the water tube 22 and water pipe 23. (Although water tube 22 is shown on the left and water pipe 23 on the right, their positions could be reversed.) Union 72 includes a left tubular member 74 having a threaded portion 75 that is threaded into the left-hand side of threaded collar 76 and retained in position by set screw 78. Union 72 also includes a right tubular member 80 having a flange 82 that is rotatably retained within the right-hand side of the threaded collar 76 by an interference fit. A teflon washer 84 (or other friction-reducing gasket) is provided between the flange 82 and the inner wall of the threaded collar 76 to reduce wear caused by rotation of the flange relative to the inner wall. A compressible gasket 86, e.g., a polyurethane spring washer, is provided between the flange and the threaded portion 75 to provide a seal and prevent leakage during use. A grease fitting 88 may be provided to allow the union to be periodically lubricated to prevent rusting.

Figure 3:
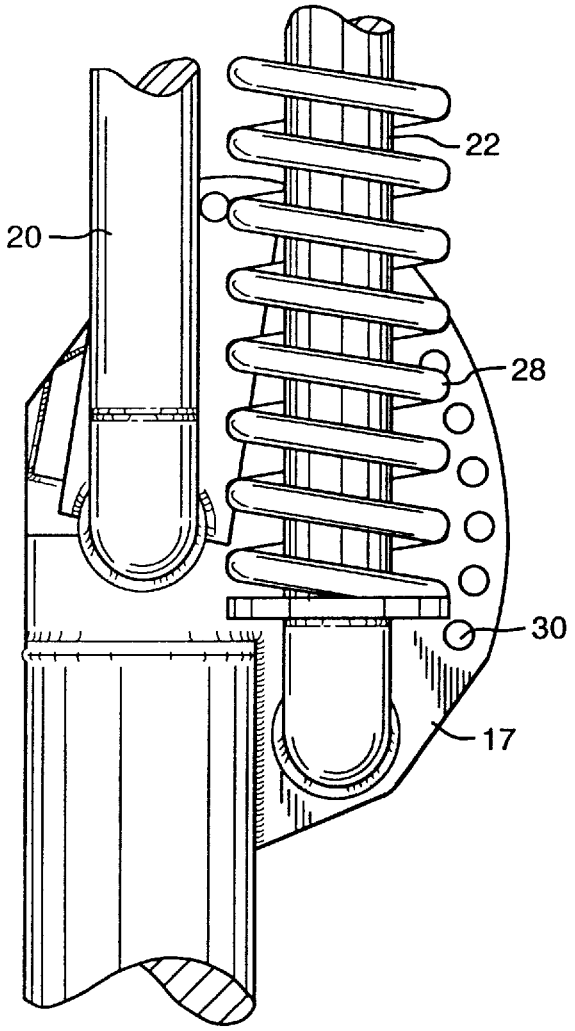
FIG. 3 is an enlarged side view of the lower portion of the tower shown in FIG. 1.

As shown in FIG. 1, and in detail in FIG. 3, a compression spring 28 is provided at the base of water tube 22. Compression spring 28 compresses as the tower is lowered, taking the weight of the tubes (approximately 2100 pounds of pressure if 1.5 inch steel tubing is used for tubes 20, 22). This allows the tower 10 to be safely, quickly and easily lowered by a person of relatively little physical strength. The spring also biases the tower towards its raised position, and thus offers a mechanical advantage when the tower 10 is to be raised, again making it easy for a person of relatively little strength to adjust the tower and increasing safety. The compression spring is preferably selected or designed to have a sufficient spring rate and total deflection to allow the tower to be easily adjusted. The spring should take substantially all of the weight of the tower but not have a spring rate that would cause the tower to recoil irretrievably after being lowered. Also, the spring should be selected/designed so that the spring can be completely compressed without going past its point of elasticity, so it can expand again after each lowering of the tower. Suitable spring characteristics for a given tower design can be readily determined. Generally, the spring rate is proportional to the length of the tower (i.e., the longer the tower the greater the spring rate). For most tower lengths suitable spring rates will be between 200 to 600 pounds per inch. Suitable deflections are generally from about 6 to 10 inches. For example, if tubes 20, 22 have a length of about 20 feet and are made of 1.5 inch steel tubing, a suitable spring has a spring rate of about 275 to 325 pounds per inch, a free length of about 22 inches, and a total deflection of about 6.5 to 7.5 inches. A preferred spring is an oil-tempered spring having a wire diameter of about 0.625", a coil diameter of about 4 inches, and squared ends.

Other embodiments are within the claims. For example, the air and water tubes could be made of aluminum or aluminum alloys and/or other material which can withstand ski area conditions (e.g., freezing). A torsion spring may be used in place of the compression spring.

What is claimed is:

1. A snow gun tower for mounting a snow gun having an air inlet, a water inlet, and a nozzle, the snow gun tower comprising:

a base plate;

an elongated air supply tube having a first end pivotally mounted on said base plate to allow the air supply tube to be rotated between a raised and a lowered position;

an elongated water supply tube disposed in spaced, parallel relation to said air supply tube and having a first end pivotally mounted on said base plate to allow the water supply tube to be rotated with the air supply tube between its raised and lowered positions; and a swivel mount at a second end of each of said air and water supply tubes constructed to be received by the air inlet and water inlet of the snow gun, said swivel mount being constructed to allow a predetermined amount of relative axial movement of said air supply tube and water supply tube during rotation of the air and water supply tubes between their raised and lowered position.

2. The snow gun tower of claim 1 further comprising a biasing member to support the weight of the tower during lowering of the tower and provide a mechanical advantage when raising the tower.

3. The snow gun tower of claim 2 wherein said biasing member comprises a compression spring.

4. The snow gun tower of claim 1 wherein said swivel mount comprises a first pivotal coupling between the air supply tube and the air inlet of the snow gun, and a second pivotal coupling between said water supply tube and the water inlet of the snow gun.

5. The snow gun tower of claim 4 wherein said first pivotal coupling includes a gasket that is compressed in response to an increase in pressure through the pivotal coupling.

6. The snow gun tower of claim 4 wherein said second pivotal coupling includes a forged union.

7. The snow gun tower of claim 6 wherein said forged union includes a compressible gasket.

8. The snow gun tower of claim 1 wherein said predetermined amount or relative axial movement is selected so that the angle of the snow gun nozzle relative to the horizon remains substantially constant during raising and lowering of the snow gun tower.

9. A snow gun tower for mounting a snow gun having an air inlet, a water inlet, and a nozzle, the snow gun tower comprising:

a base plate;

an elongated air supply tube having a first end pivotally mounted on said base plate to allow the air supply tube to be rotated between a raised and a lowered position;

an elongated water supply tube disposed in spaced, parallel relation to said air supply tube and having a first end pivotally mounted on said base plate to allow the water supply tube to be rotated with the air supply tube between its raised and lowered positions;

a snow gun mount at a second end of said air and water supply tubes, constructed to receive the air and water inlets of the snow gun; and a biasing member mounted on the supply tube that is closest to the ground when the air and water supply tubes are in their lowered positions, to provide a mechanical advantage when the tubes are moved between their raised and lowered positions by supporting a portion of the weight of the tubes.

10. The snow gun tower of claim 9 wherein said biasing member is a compression spring.

11. The snow gun tower of claim 10 wherein said compression spring has a spring rate of from about 200 to 600 pounds/inch.

12. The snow gun tower of claim 10 wherein said compression spring has a total deflection of from about 6 to 10 inches.

13. The snow gun tower of claim 9 wherein said biasing member is constructed to support substantially all of the weight of the tower during lowering of the tower.

* * * * *